US009010120B2

(12) United States Patent
DiCintio et al.

(10) Patent No.: US 9,010,120 B2
(45) Date of Patent: Apr. 21, 2015

(54) ASSEMBLIES AND APPARATUS RELATED TO INTEGRATING LATE LEAN INJECTION INTO COMBUSTION TURBINE ENGINES

(75) Inventors: Richard Martin DiCintio, Simpsonville, SC (US); Patrick Benedict Melton, Horse Shoe, NC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 890 days.

(21) Appl. No.: 13/204,369

(22) Filed: Aug. 5, 2011

(65) Prior Publication Data

US 2013/0031908 A1 Feb. 7, 2013

(51) Int. Cl.

| | |
|---|---|
| ***F02C 1/00*** | (2006.01) |
| ***F23R 3/06*** | (2006.01) |
| ***F23R 3/28*** | (2006.01) |
| ***F23R 3/34*** | (2006.01) |
| ***F23R 3/60*** | (2006.01) |

(52) U.S. Cl.

CPC . *F23R 3/06* (2013.01); *F23R 3/283* (2013.01); *F23R 3/346* (2013.01); *F23R 3/60* (2013.01); *F23R 2900/00012* (2013.01); *F23R 2900/00017* (2013.01); *F23R 2900/03044* (2013.01)

(58) Field of Classification Search

USPC ..... 60/752–760, 746

See application file for complete search history.

(56) References Cited

U.S. PATENT DOCUMENTS

| | | | |
|---|---|---|---|
| 3,055,179 | A | 9/1962 | Lefebvre et al. |
| 3,099,134 | A | 7/1963 | Calder et al. |
| 3,872,664 | A | 3/1975 | Lohmann et al. |
| 3,924,576 | A | 12/1975 | Siewert |
| 3,934,409 | A | 1/1976 | Quillevere et al. |
| 4,028,888 | A | 6/1977 | Pilarczyk |
| 4,192,139 | A | 3/1980 | Buchheim |
| 4,236,378 | A | 12/1980 | Vogt |
| 4,265,615 | A | 5/1981 | Lohmann et al. |
| 4,271,674 | A | 6/1981 | Marshall et al. |
| 4,420,929 | A | 12/1983 | Jorgensen et al. |
| 4,543,894 | A | 10/1985 | Griswold et al. |
| 4,590,769 | A | 5/1986 | Lohmann et al. |
| 4,603,548 | A | 8/1986 | Ishibashi et al. |
| 4,872,312 | A | 10/1989 | Iizuka et al. |
| 4,928,481 | A | 5/1990 | Joshi et al. |
| 4,955,191 | A | 9/1990 | Okamoto et al. |
| 4,989,549 | A | 2/1991 | Korenberg |
| 4,998,410 | A | 3/1991 | Martinez-Leon et al. |
| 5,054,280 | A | 10/1991 | Ishibashi et al. |
| 5,076,229 | A | 12/1991 | Stanley |
| 5,099,644 | A | 3/1992 | Sabla et al. |
| 5,127,229 | A | 7/1992 | Ishibashi et al. |

(Continued)

*Primary Examiner* — Gerald L Sung

(74) *Attorney, Agent, or Firm* — Mark E. Henderson; Ernest G. Cusick; Frank A. Landgraff

(57) ABSTRACT

A transfer tube for use in a late lean injection system of a combustor, wherein the combustor includes an inner radial wall, which defines a primary combustion chamber downstream of a primary fuel nozzle, and an outer radial wall, which surrounds the inner radial wall forming a flow annulus therebetween, the outer radial wall including a late lean nozzle, the transfer tube including flow directing structure that defines a fluid passageway. At a first end, the flow directing structure may include an inlet and attachment means that attach the transfer tube to the late lean nozzle. The flow directing structure may have a configuration such that the fluid passageway spans the flow annulus and positions the outlet at a desirable injection point in the inner radial wall.

20 Claims, 9 Drawing Sheets

(56) References Cited

U.S. PATENT DOCUMENTS

| | | | | |
|---|---|---|---|---|
| 5,259,184 | A | 11/1993 | Borkowicz et al. | |
| 5,274,991 | A | 1/1994 | Fitts | |
| 5,323,600 | A | 6/1994 | Munshi | |
| 5,350,293 | A | 9/1994 | Khinkis et al. | |
| 5,394,688 | A | 3/1995 | Amos | |
| 5,408,825 | A | 4/1995 | Foss et al. | |
| 5,450,725 | A | 9/1995 | Takahara et al. | |
| 5,479,782 | A | 1/1996 | Parker et al. | |
| 5,481,866 | A | 1/1996 | Mowill | |
| 5,518,395 | A | 5/1996 | Maughan | |
| 5,623,819 | A | 4/1997 | Bowker et al. | |
| 5,638,674 | A | 6/1997 | Mowill | |
| 5,640,851 | A | 6/1997 | Toon et al. | |
| 5,647,215 | A | 7/1997 | Sharifi et al. | |
| 5,657,632 | A | 8/1997 | Foss | |
| 5,687,571 | A | 11/1997 | Althaus et al. | |
| 5,749,218 | A | 5/1998 | Cromer et al. | |
| 5,749,219 | A | 5/1998 | DuBell | |
| 5,802,854 | A | 9/1998 | Maeda et al. | |
| 5,826,429 | A | 10/1998 | Beebe et al. | |
| 5,829,967 | A | 11/1998 | Chyou | |
| 5,850,731 | A | 12/1998 | Beebe et al. | |
| 5,878,566 | A | 3/1999 | Endo et al. | |
| 6,047,550 | A | 4/2000 | Beebe | |
| 6,092,363 | A | 7/2000 | Ryan | |
| 6,182,451 | B1 | 2/2001 | Hadder | |
| 6,192,688 | B1 | 2/2001 | Beebe | |
| 6,289,851 | B1 | 9/2001 | Rabovitser et al. | |
| 6,343,462 | B1 | 2/2002 | Drnevich et al. | |
| 6,418,725 | B1 | 7/2002 | Maeda et al. | |
| 6,513,334 | B2 | 2/2003 | Varney | |
| 6,609,493 | B2 | 8/2003 | Yamaguchi et al. | |
| 6,663,380 | B2 | 12/2003 | Rabovitser et al. | |
| 6,705,117 | B2 | 3/2004 | Simpson et al. | |
| 6,775,987 | B2 | 8/2004 | Sprouse et al. | |
| 6,868,676 | B1 | 3/2005 | Haynes | |
| 7,040,094 | B2 | 5/2006 | Fischer et al. | |
| 7,082,770 | B2 | 8/2006 | Martling et al. | |
| 7,149,632 | B1 | 12/2006 | Gao et al. | |
| 7,185,497 | B2 | 3/2007 | Dudebout et al. | |
| 7,198,483 | B2 | 4/2007 | Bueche et al. | |
| 7,302,801 | B2 | 12/2007 | Chen | |
| 7,303,388 | B2 | 12/2007 | Joshi et al. | |
| 7,685,823 | B2 | 3/2010 | Martling et al. | |
| 7,757,491 | B2 | 7/2010 | Hessler | |
| 8,381,532 | B2 * | 2/2013 | Berry et al. | 60/795 |
| 8,656,721 | B2 * | 2/2014 | Matsumoto et al. | 60/733 |
| 8,689,559 | B2 * | 4/2014 | Kraemer et al. | 60/733 |
| 2001/0049932 | A1 | 12/2001 | Beebe | |
| 2002/0148230 | A1 * | 10/2002 | Halila et al. | 60/796 |
| 2003/0010035 | A1 | 1/2003 | Farmer et al. | |
| 2003/0024234 | A1 | 2/2003 | Holm et al. | |
| 2007/0234733 | A1 | 10/2007 | Harris et al. | |
| 2008/0072599 | A1 | 3/2008 | Morenko et al. | |
| 2008/0264033 | A1 | 10/2008 | Lacy et al. | |
| 2009/0084082 | A1 | 4/2009 | Martin et al. | |
| 2010/0170216 | A1 | 7/2010 | Venkataraman et al. | |
| 2010/0170219 | A1 | 7/2010 | Venkataraman et al. | |
| 2010/0170251 | A1 | 7/2010 | Davis, Jr. et al. | |
| 2010/0170252 | A1 | 7/2010 | Venkataraman et al. | |
| 2010/0170254 | A1 | 7/2010 | Venkataraman et al. | |
| 2010/0174466 | A1 | 7/2010 | Davis, Jr. et al. | |
| 2010/0229557 | A1 * | 9/2010 | Matsumoto et al. | 60/737 |
| 2010/0242482 | A1 * | 9/2010 | Kraemer et al. | 60/746 |

* cited by examiner

ASSEMBLIES AND APPARATUS RELATED TO INTEGRATING LATE LEAN INJECTION INTO COMBUSTION TURBINE ENGINES

BACKGROUND OF THE INVENTION

The present invention relates to combustion turbine engines, and more particularly, to integrating late lean injection into the combustion liner of combustion turbine engines, late lean injection sleeve assemblies, and/or methods of manufacture related thereto.

Multiple designs exist for staged combustion in combustion turbine engines, but most are complicated assemblies consisting of a plurality of tubing and interfaces. One kind of staged combustion used in combustion turbine engines is late lean injection. In this type of stage combustion, late lean fuel injectors are located downstream of the primary fuel injector. As one of ordinary skill in the art will appreciate, combusting a fuel/air mixture at this downstream location may be used to improve NOx performance. NOx, or oxides of nitrogen, is one of the primary undesirable air polluting emissions produced by combustion turbine engines that burn conventional hydrocarbon fuels. The late lean injection may also be function as an air bypass, which may be used to improve carbon monoxide or CO emissions during "turn down" or low load operation. It will be appreciated that late lean injection systems may provide other operational benefits.

Current late lean injection assemblies are expensive and costly for both new gas turbine units and retrofits of existing units. One of the reasons for this is the complexity of conventional late lean injection systems, particularly those systems associated with the fuel delivery. The many parts associated with these complex systems must be designed to withstand the extreme thermal and mechanical loads of the turbine environment, which significantly increases manufacturing expense. Even so, conventional late lean injection assemblies still have a high risk for fuel leakage into the compressor discharge casing, which can result in auto-ignition and be a safety hazard. In addition, the complexity of conventional systems increases the cost to assembly.

As a result, there is a need form improved late lean injection systems, components, and methods of manufacture, particularly those that reduce system complexity, assembly time, and manufacturing cost.

BRIEF DESCRIPTION OF THE INVENTION

The present application thus describes a transfer tube for use in a late lean injection system of a combustor of a combustion turbine engine, wherein the combustor includes a liner forming an inner radial wall, which defines a primary combustion chamber downstream of a primary fuel nozzle, and an outer radial wall forming a flow sleeve, which surrounds the liner forming a flow annulus therebetween, wherein the flow sleeve includes a late lean nozzle. The transfer tube may include flow directing structure that defines a fluid passageway, wherein: at a first end, the flow directing structure includes an inlet and, about the inlet, attachment means, the attachment means configured to rigidly connect the transfer tube to the late lean nozzle; at a second end, the flow directing structure includes an outlet; the flow directing structure comprises a configuration such that the fluid passageway spans the flow annulus and positions the outlet at a desirable injection point in the liner along an inner wall surface of the liner; and the flow directing structure comprises a tube having a predetermined length, the predetermined length corresponding with the distance between the late lean nozzle and the desirable injection point.

The present invention may further include a transfer tube for use in a late lean injection system of a combustor of a combustion turbine engine, wherein the combustor includes a liner forming an inner radial wall, which defines a primary combustion chamber downstream of a primary fuel nozzle, and an outer radial wall forming a flow sleeve, which surrounds the liner forming a flow annulus therebetween, wherein the flow sleeve includes a late lean nozzle. The transfer tube may include flow directing structure that defines a fluid passageway; wherein: at a first end, the flow directing structure includes an inlet and, about the inlet, attachment means, the attachment means configured to rigidly connect the transfer tube to the late lean nozzle; at a second end, the flow directing structure includes an outlet; the flow directing structure comprises a configuration such that the fluid passageway spans the flow annulus and positions the outlet at a desirable injection point in the liner along an inner wall surface of the liner; and the flow directing structure comprises a tube having a predetermined length, the predetermined length corresponding with the distance between the late lean nozzle and the desirable injection point.

These and other features of the present application will become apparent upon review of the following detailed description of the preferred embodiments when taken in conjunction with the drawings and the appended claims.

DETAILED DESCRIPTION OF THE INVENTION

Figure 1:
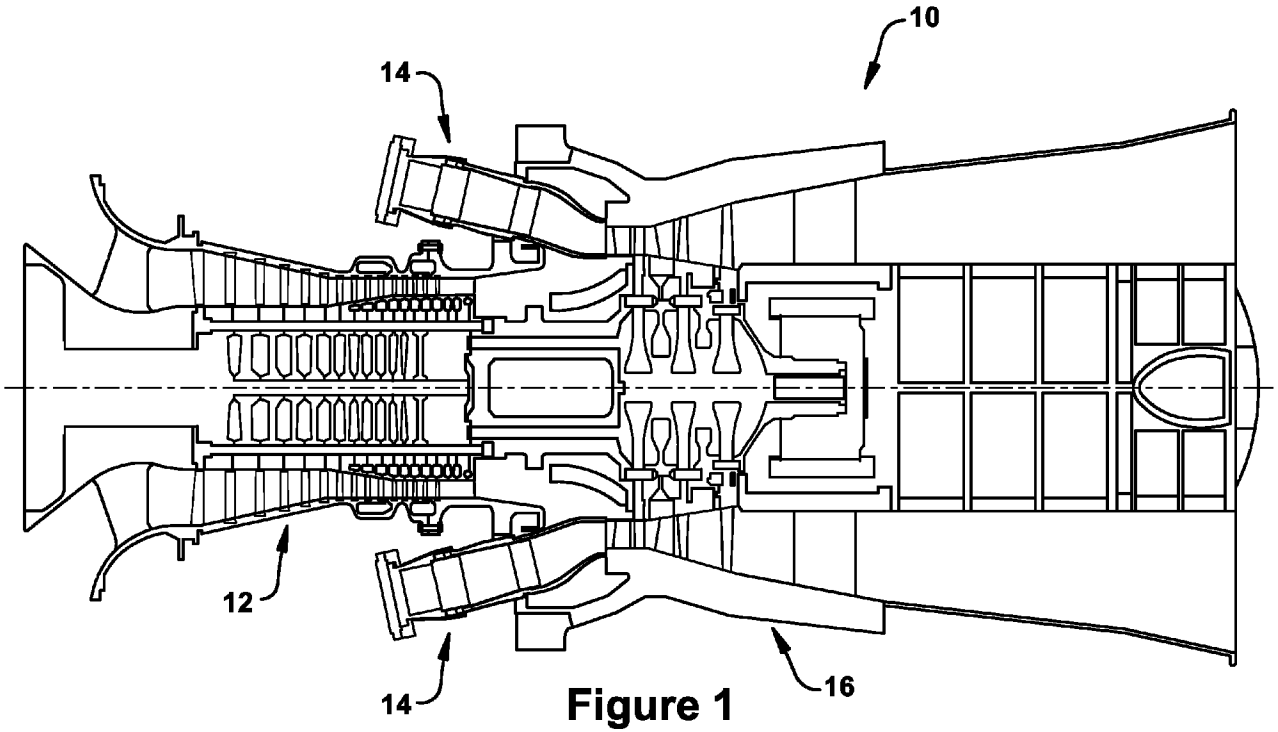
Figure 1 (Prior Art)
FIG. 1 is a section view of a combustion turbine system in which embodiments of the present invention may be used.

FIG. 1 is an illustration showing a typical combustion turbine system 10. The gas turbine system 10 includes a compressor 12, which compresses incoming air to create a supply of compressed air, a combustor 14, which burns fuel so as to produce a high-pressure, high-velocity hot gas, and a turbine 16, which extracts energy from the high-pressure, high-velocity hot gas entering the turbine 16 from the combustor 14 using turbine blades, so as to be rotated by the hot gas. As the turbine 16 is rotated, a shaft connected to the turbine 16 is caused to be rotated as well, the rotation of which may be used to drive a load. Finally, exhaust gas exits the turbine 16.

Figure 2:
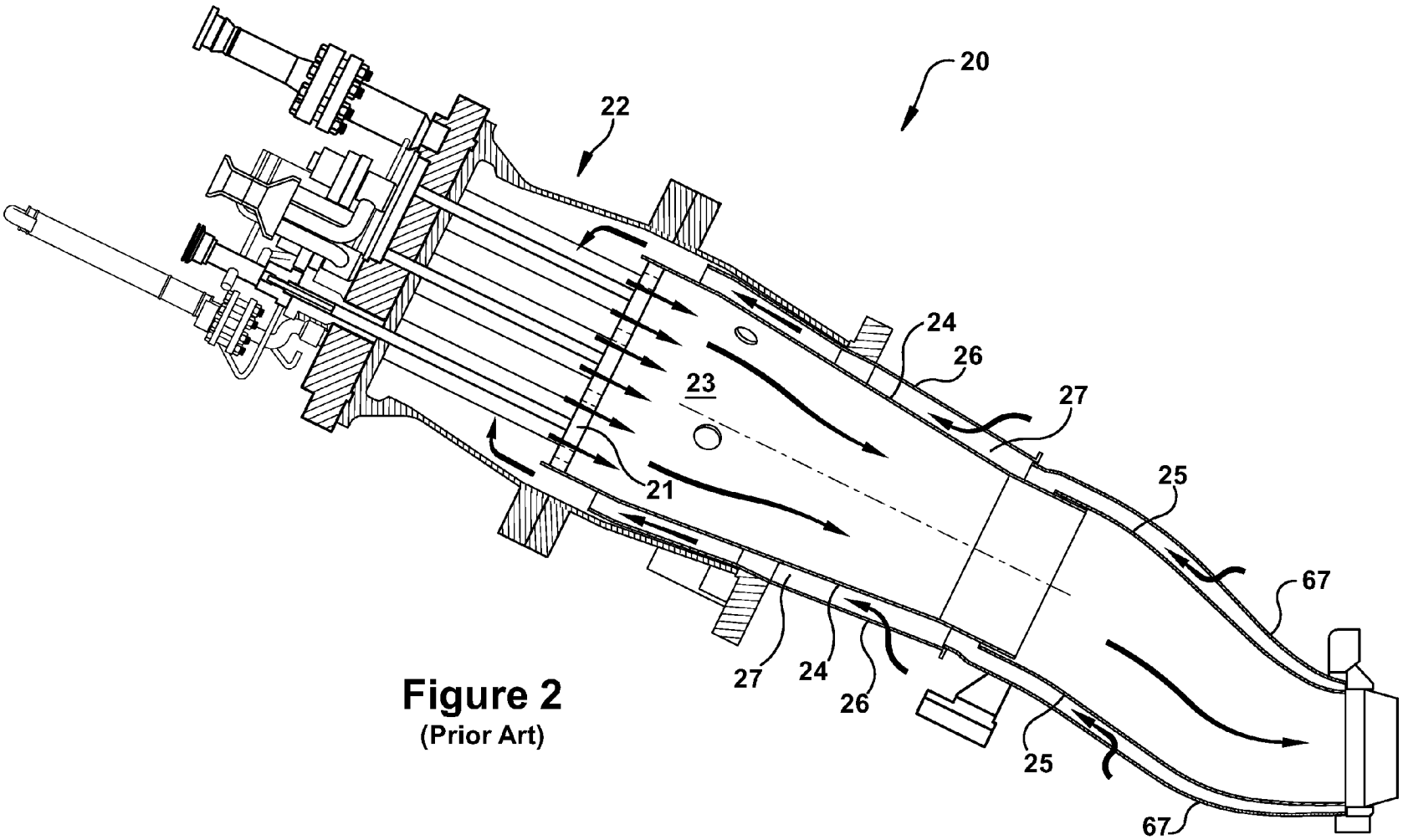
Figure 2 (Prior Art)
FIG. 2 is a section view of a conventional combustor in which embodiments of the present invention may be used.

FIG. 2 is a section view of a conventional combustor in which embodiments of the present invention may be used. Though the combustor 20 may take various forms, each of which being suitable for including various embodiments of the present invention, typically, the combustor 20 includes a head end 22, which includes multiple fuel nozzles 21 that bring together a flow of fuel and air for combustion within a primary combustion zone 23, which is defined by a surrounding liner 24. The liner 24 typically extends from the head end 22 to a transition piece 25. The liner 24, as shown, is surrounded by a flow sleeve 26. The transition piece 25 is surrounded by an impingement sleeve 67. Between the flow sleeve 26 and the liner 24 and the transition piece 25 and impingement sleeve 67, it will be appreciated that an annulus, which will be referred to herein as a "flow annulus 27", is formed. The flow annulus 27, as shown, extends for a most of the length of the combustor 20. From the liner 24, the transition piece 25 transitions the flow from the circular cross section of the liner 24 to an annular cross section as it travels downstream to the turbine section (not shown). At a downstream end, the transition piece 25 directs the flow of the working fluid toward the airfoils that are positioned in the first stage of the turbine 16.

It will be appreciated that the flow sleeve 26 and impingement sleeve 27 typically has impingement apertures (not shown) formed therethrough which allow an impinged flow of compressed air from the compressor 12 to enter the flow annulus 27 formed between the flow sleeve 26/liner 24 and/or the impingement sleeve 67/transition piece 25. The flow of compressed air through the impingement apertures convectively cools the exterior surfaces of the liner 24 and transition piece 25. The compressed air entering the combustor 20 through the flow sleeve 26 is directed toward the forward end of the combustor 20 via the flow annulus 27 formed about the liner 24. The compressed air then may enter the fuel nozzles 21, where it is mixed with a fuel for combustion within the combustion zone 23.

As noted above, the turbine 16 includes turbine blades, into which products of the combustion of the fuel in the liner 24 are received to power a rotation of the turbine blades. The transition piece directs the flow of combustion products into the turbine 16, where it interacts with the blades to induce rotation about the shaft, which, as stated, then may be used to drive a load, such as a generator. Thus, the transition piece 25 serves to couple the combustor 20 and the turbine 16. In systems that include late lean injection, it will be appreciated that the transition piece 25 also may define a secondary combustion zone in which additional fuel supplied thereto and the products of the combustion of the fuel supplied to the liner 24 combustion zone are combusted.

Figure 3:
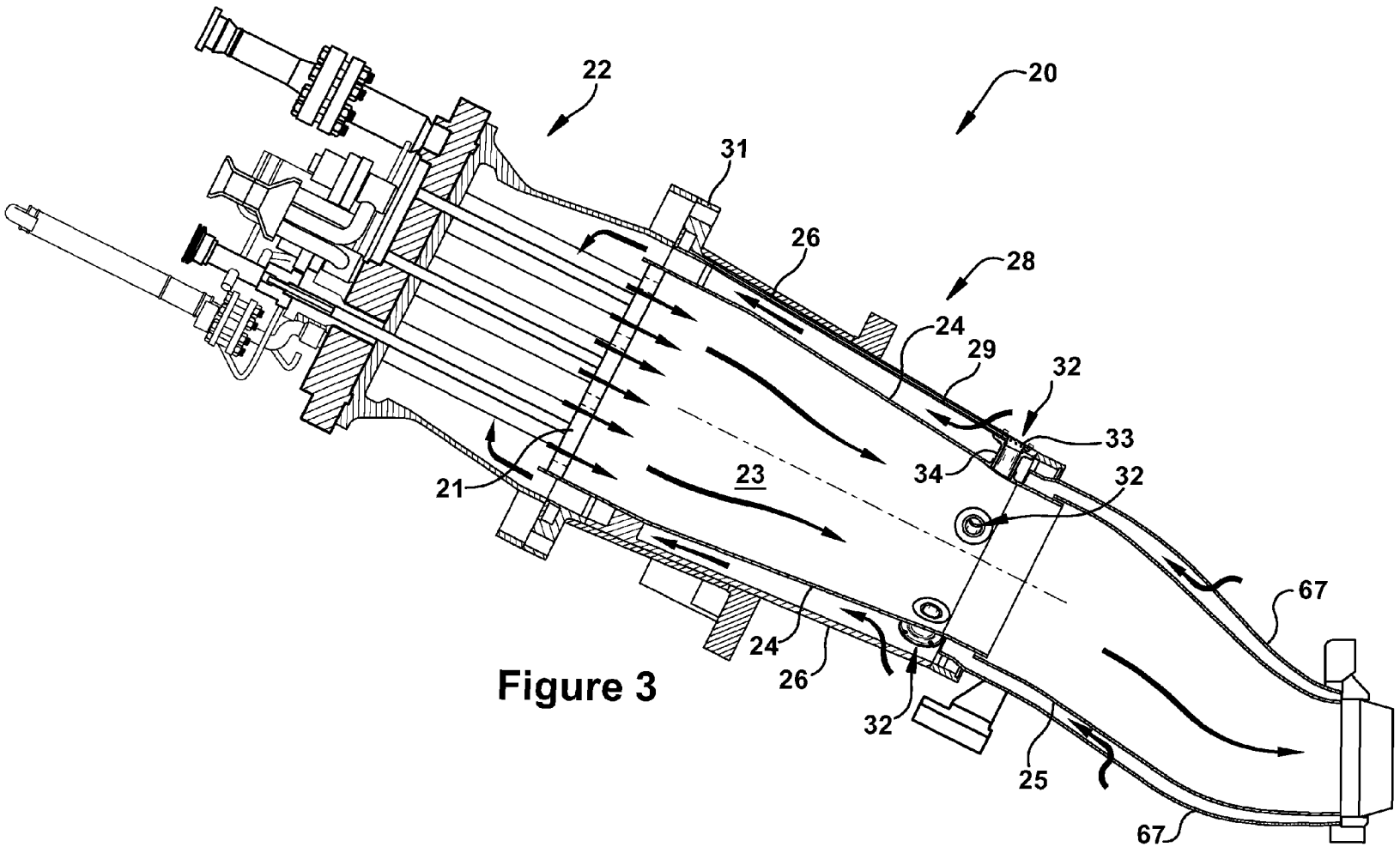
FIG. 3 is a section view of a combustor that includes a late lean injection system according to an embodiment of the present invention.
Figure 4:
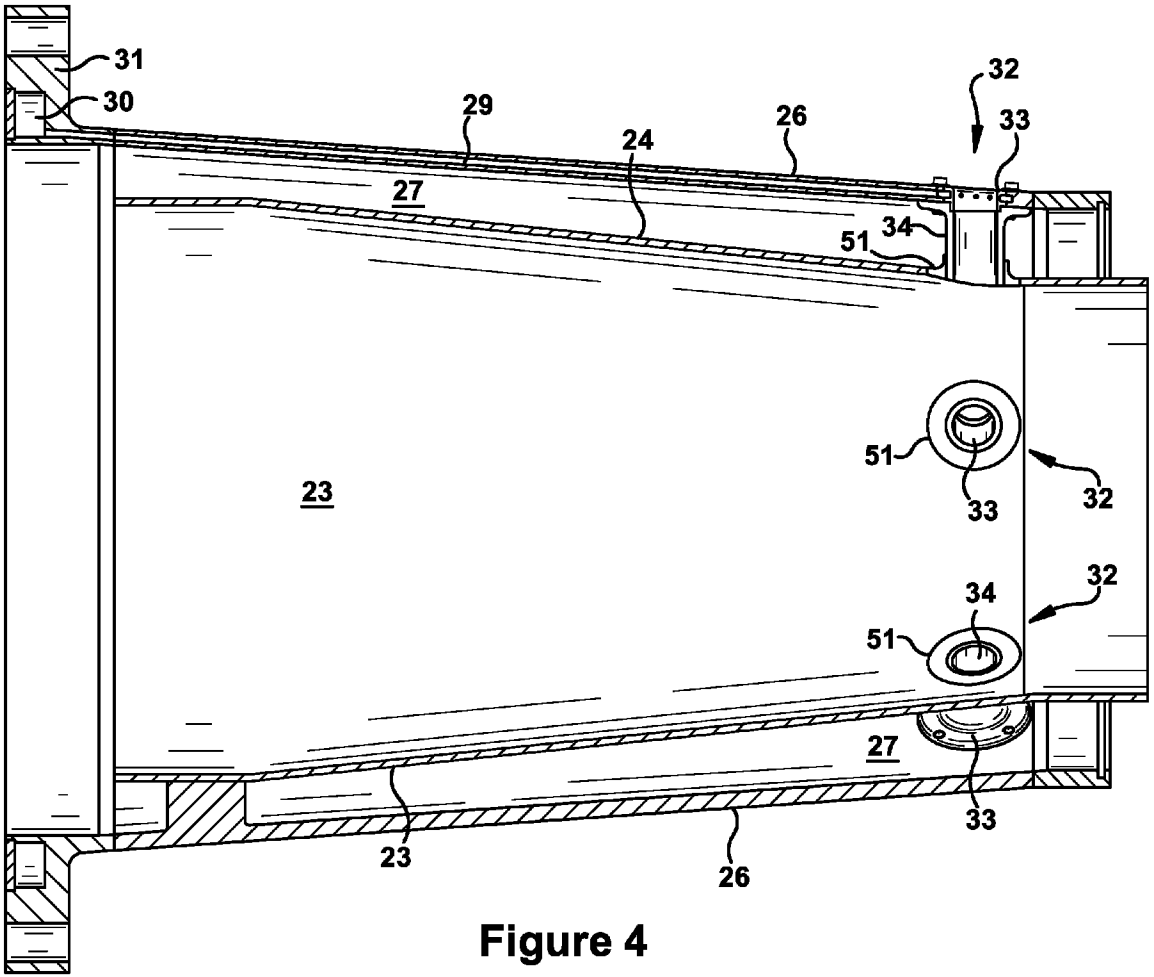
FIG. 4 is a section view of a flow sleeve and liner assembly that includes a late lean injection system according to an embodiment of the present invention.

FIGS. 3 and 4 provide views of late lean injection systems 28 according to aspects of exemplary embodiments of the present invention. As used herein, a "late lean injection system" is a system for injecting a mixture of fuel and air into the flow of working fluid at any point that is downstream of the primary fuel nozzles 21 and upstream of the turbine 16. In certain embodiments, a "late lean injection system 28" is more specifically defined as a system for injecting a fuel/air mixture into the aft end of the primary combustion chamber defined by the liner. In general, one of the objectives of late lean injection systems includes enabling fuel combustion that occurs downstream of primary combustors/primary combustion zone. This type of operation may be used to improve NOx performance, however, as one of ordinary skill in the relevant art will appreciate, combustion that occurs too far downstream may result in undesirable higher CO emissions. As described in more detail below, the present invention provides effective alternatives for achieving improved NOx emissions, while avoiding undesirable results. Further, the late lean injection system 28 of the present invention also allows for the elimination of compressor discharge case ("CDC") piping, flexhoses, sealed connections, etc. It also provides a simple assembly for integrating late lean injection into the combustion liner of a gas turbine as well as efficient methods of manufacturing and assembling such systems.

It will be appreciated that aspects of the present invention provide ways in which a fuel/air mixture may be injected into aft areas of the combustion zone 23 and/or liner 24. As shown, the late lean injection system 28 may include a fuel passageway 29 defined within the flow sleeve 26. The fuel passageway 29 may originate at a fuel manifold 30 defined within a flow sleeve flange 31, which is positioned at the forward end of the flow sleeve 26. The fuel passageway 29 may extend from the fuel manifold 30 to a late lean injector 32. As shown the late lean injectors 32 may be positioned at or near the aft end of the flow sleeve 26. According to certain embodiments, the late lean injectors 32 may include a nozzle or late lean nozzle 33 and a transfer tube 34. As described in more detail below, the late lean nozzle 33 and the transfer tube 34 may carry compressed air from the CDC to the combustion zone 23 inside of the liner 24. Along the way, the compressed air may mix with fuel that is delivered through the late lean nozzle 33. Small openings or fuel outlets 63 formed around the inner wall of the late lean nozzle 33 may inject the fuel that is delivered to the lean nozzle 33 via the fuel passageway 29. The transfer tube 34 carries the fuel/air mixture across the flow annulus 27 and injects the mixture into the flow of hot gas within the liner 24. The fuel/air mixture then may combust within the flow of hot gas, thereby adding more energy to the flow and improving NOx emissions.

As shown more clearly in FIG. 4, the fuel passageways 29, which may be drilled or formed in other conventional ways, generally extends in an axially direction so to deliver fuel to one of the late lean injectors 32. The fuel inlet for the fuel passageway 29 may connect to the fuel manifold 30 formed within the flow sleeve flange 31, which is positioned at the head/upstream end of the combustor liner 24. Those of ordinary skill in the art will appreciate that other configurations for the inlet of the fuel passageway 29 are also possible. Accordingly, in operation, fuel flows from the fuel manifold 30, through the fuel passageways 29 formed through the flow sleeve 26, and then to the late lean injectors 32. The late lean nozzle 33 may be configured to accept the flow of fuel and distribute it through the fuel outlets 63 that are arrayed about the inner wall of the late lean nozzle 33 so that the fuel mixes with the flow of CDC air entering the late lean nozzle 33 from the exterior of the flow sleeve 26.

In a preferred embodiment, there are between 3 and 5 late lean injectors positioned circumferentially around the flow sleeve 26/liner 24 so that a fuel/air mixture is introduced at multiple points around the liner 24, though more or less late lean injectors may also be present. It should be noted that a fuel/air mixture is injected into the liner 24 because the late lean nozzles 33 inject a fuel into a fast moving supply of compressed air that is entering the late lean nozzle 33 from the CDC cavity. This air bypasses the head end 22 and, instead, participates in the late lean injection. As stated, each of the late lean injectors 32 includes a collar-like nozzle in which a number of small fuel outlets 63 are formed. Fuel flows from the fuel passageway 29 in the flow sleeve 26 to and through these fuel outlets 63, where it mixes with compressed air. Then the fuel/air mixture travels through the flow path defined by the late lean nozzle 33/transfer tube 34 and, from there, into the flow of hot gas moving through the combustion liner 24. The burning combustion products in the liner 24 then ignite the newly introduced fuel/air mixture from the late lean injectors 32.

It will be appreciated that the late lean injectors 32 may also be installed in similar fashion at positions further aft in a combustor than those shown in the various figures, or, for that matter, anywhere where a flow assembly is present that has the same basic configuration as that described above for the liner 24/flow sleeve 26 assembly. For example, using the same basic assembly methods and components, the late lean injectors 32 may be positioned within the transition piece 25/impingement sleeve 67 assembly. In this instance, the fuel passageway 29 may be extended to make the connection with the late lean injectors 32. In this manner, a fuel/air mixture may be injected into the hot-gas flow path within the transition piece 25, which, as one of ordinary skill in the art will appreciate, may be advantageous given certain system criteria and operator preferences. While description herein is primarily aimed at an exemplary embodiment within the liner 24/flow sleeve 26 assembly, it will be appreciated that this is not meant to be limiting.

The fuel from the fuel passageway 29 is mixed in the late lean injectors 32 with air from the CDC air supply and the mixture is injected into the interior of the liner 24. As can be seen in more detail in FIGS. 5 through 10, each of the individual late lean injectors 32 may include a late lean nozzle 33, which is embedded in the wall of the flow sleeve 26 and, therein, forms a connection with the fuel passageway 29 that is defined within the flow sleeve 26. The late lean injectors 32 may further include a transfer tube 34, which connects to the late lean nozzle 33 and spans the flow annulus 27. Those of ordinary skill in the art will appreciate that the late lean injectors 32 may include additional components or may be constructed as a single component. The description herein of a late lean injector including two connectable components represents a preferred embodiment, the advantages of which will become clear in the discussion below.

Figure 5:
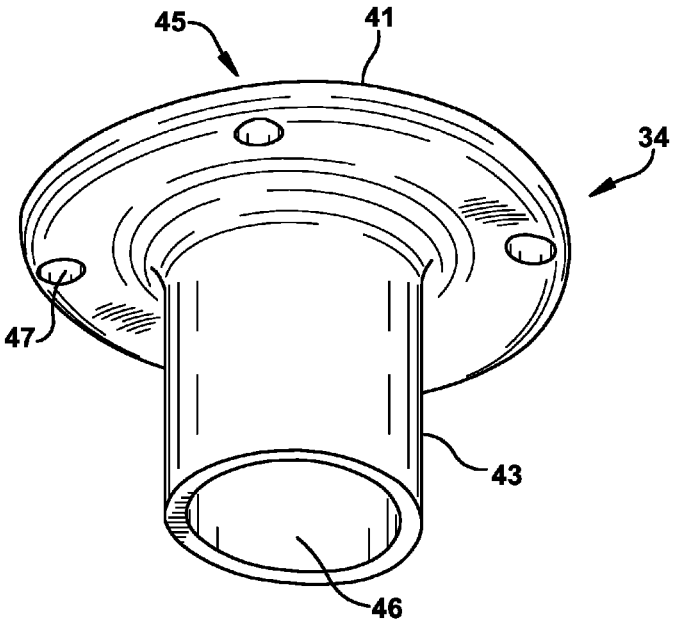
FIG. 5 is a perspective view of a transfer tube according to an embodiment of the present invention.
Figure 6:
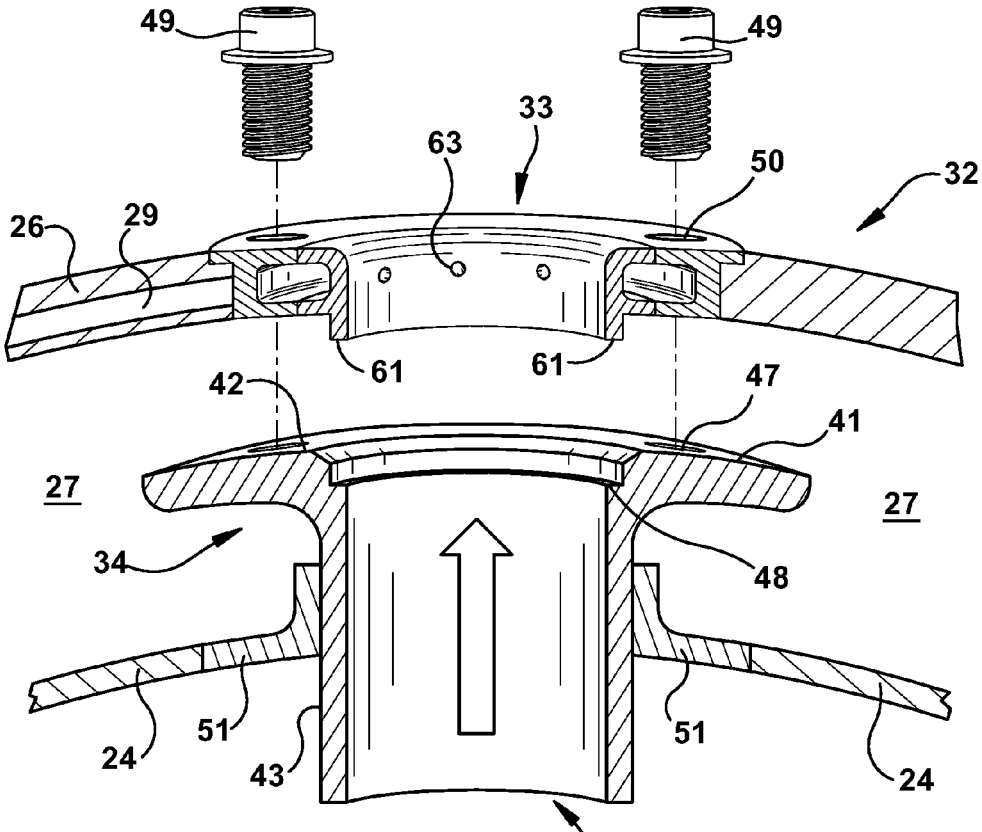
FIG. 6 is a section view of a late lean injector/transfer tube assembly according to an embodiment of the present invention in an unassembled state.
Figure 7:
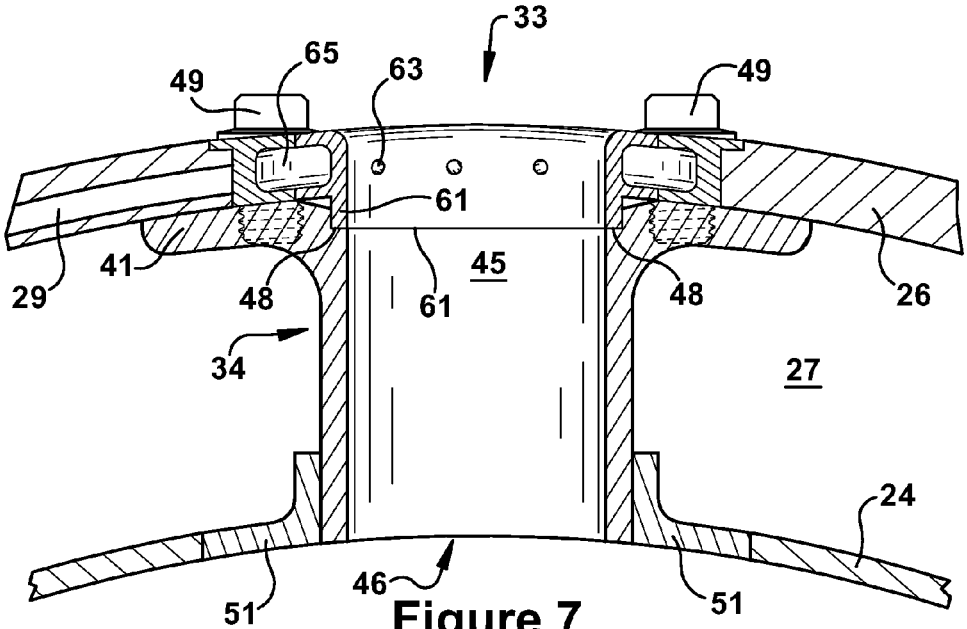
FIG. 7 is a section view of a late lean injector/transfer tube assembly according to an embodiment of the present invention in an assembled state.

Referring to FIG. 5 through 7, the late lean nozzle 33 may have a cylindrical "collar" configuration, and may contain an annular fuel manifold contained within this structure. The annular fuel manifold may fluidly connect with the fuel passageway 29. The late lean nozzle 33 many include a plurality of holes or fuel outlets 63 formed on the inner surface of the cylindrical structure that provide injection points through which fuel flowing is injected into the flow of compressed air through the late lean nozzle 33. In this manner, the late lean nozzle 33 may inject fuel into the hollow passageway defined by its cylindrical shape. It will be appreciated that the hollow passageway defined by the cylindrical shape may be aligned such that it provides a passageway through the flow sleeve 26, which, in operation, will allow compressed to flow into the late lean nozzle 33 and mix with the fuel being supplied through the fuel outlets 63. In preferred embodiments, the fuel outlets 63 may be regularly spaced around the inner surface of the late lean nozzle 33 so that mixture with the air moving therethrough is enhanced. The late lean nozzle 33 may include a mechanism for connecting to the transfer tube 34, as discussed below. In certain embodiments, the mechanism for connecting may include a flange 65 configured to engage a plurality of bolts 49.

In a preferred embodiment, the transfer tube 34, as shown in FIG. 5, provides a closed passageway that fluidly connects the late lean nozzle 33 to a late lean injection point within the liner 24. The transfer tube 34 may attach rigidly to the late lean nozzle 33 in a manner that reduces leakage. The transfer tube 34 may direct/carry the fuel/air mixture from the late lean nozzle 33 to an injection point that is located along the inner surface of the liner 24. The transfer tube 34 may span the distance between the flow sleeve 26 and liner 24 (i.e., across the flow annulus 27 that carries CDC air to forward areas of the combustor or the head end 22) and, thereby, provide the fuel/air mixture to the injection point while minimizing air losses and/or fuel leakages. The burning combustion products in the liner 24 ignite the fuel newly introduced through the late lean injectors 32 and the fuel combusts with the oxygen contained in the injected mixture. In this manner, additional fuel/air mixture is added to the flow of hot combustion gases already moving through the interior of the liner 24 and combusted therein, which adds energy to the flow of working fluid before it is expanded through the turbine 16. In addition, as described above, the addition of the fuel/air mixture in this manner may be used to improve NOx emissions as well as achieve other operational objectives. The number of late lean injectors 32 may be varied, depending on the fuel supply requirements and optimization of the combustion process.

In certain embodiments, the transfer tube 34 may be described as including flow directing structure that defines a fluid passageway. At one end, the flow directing structure includes an inlet 45 and, about the inlet 45, an attachment mechanism. In certain embodiments, the attachment mechanism includes a flange 41 and bolt 49 assembly, though other mechanical attachments may be used. The attachment mechanism may be configured to rigidly connect the transfer tube 34 to the late lean nozzle 33. At the other end, the flow directing structure includes an outlet 46. The flow directing structure, as shown, may be configured such that the fluid passageway it defines spans the flow annulus 27 and positions the outlet 46 at a desirable injection point in the liner 24. The desirable injection point may include a position along an inner wall surface of the liner 24. The flow directing structure may include a tube having a predetermined length. The predetermined length may correspond with the distance between the late lean nozzle 33 and the desirable injection point.

At one end, the transfer tube 34 may include a configuration that desirably engages a boss 51 installed through the liner 24. The boss 51 may define a hollow passageway through the liner 24. In certain embodiments, the transfer tube 34 may slidably engage the boss 51. As discussed more below, this may aid in the assembly of the liner 24/flow sleeve 26 assembly per embodiments of the present invention. While being slidably engaged, the transfer tube 34 may fit relatively snugly within the boss 51, with little clearance between the two components. In general, the transfer tube 34 may be configured to fluidly connect the late lean nozzle 33 to the injection point such that, in operation, the fuel/air mixture flowing from the late lean nozzle 33 is separated from the compressed air flowing through the flow annulus.

In a preferred embodiment, as shown in an unassembled and assembled state in FIGS. 6 and 7, respectively, the transfer tube 34 may attached to the late lean nozzle 33 via a flange/bolt assembly. That is, the transfer tube 34 may include a flange 41 (that includes bolt holes 47), and the late lean nozzle 33 may include a flange 65 (that includes bolt holes 50). Bolts 49 then may be used to connect the flanges 41, 65 such that an assembled late lean injector 32 is assembled. It will be appreciated that such connecting mechanism provides that, upon engaging, the transfer tube, which, as stated is slidably engaged within the boss 51, is drawn toward the late lean nozzle 33 until the flanges 41, 65 of each component are tight against each other.

More specifically, the flange 41 may surround the inlet 45 of the transfer tube. The flange 41 may include a plurality of threaded openings configured to engage bolts that originate from the late lean nozzle 33. Each of the threaded openings may be configured such that engagement of the bolts draws the flange 41 toward the late lean nozzle 33. The flange 41 may include a compression seat 42 against which a corresponding surface on the late lean nozzle 33 may be drawn when the bolts are fully engaged. In addition, the transfer tube may include a narrowing ledge 48 just inside of the inlet 45, as shown. The narrowing ledge 48 may be configured to provide a compression seat against which an edge of a projection ring 61 formed as an outlet of the late lean nozzle 33 may be drawn when the bolts are fully engaged. It will be appreciated that the compression seat 42 and narrowing ledge 48 provide means by which the fluid connection between the transfer tube and late lean nozzle 33 may be sealed.

It will be appreciated that the inner surface of the flow sleeve 26 forms the outer radial boundary of the flow annulus, and that the inner surface of the flow sleeve 26 includes a surface contour that depends on the shape of the flow sleeve 26. Because the flow sleeve 26 often is cylindrical in shape, the surface contour of the flow sleeve 26 is a curved, rounded shape. In certain embodiments of the present invention, the outer face of the flange 41 may include a surface contour that matches the surface contour of the flow sleeve 26. Thus, the outer face of the flange 41 may be configured to correspond to the curved inner surface of the flow sleeve 26. In embodiments where the flow sleeve 26 is cylindrical in shape, the outer face of the flange 41 may have a rounded curvature that matches that shape. In this manner, the surface contour of the outer flange 41 may be configured such that, when the engagement of the bolts draws the flange 41 against the flow sleeve 26, the matching contours press tightly against each other over a large surface area. More specifically, in preferred embodiments, substantially all of the outer face of the flange 41 may be drawn tightly against the inner surface of the flow sleeve 26.

In certain embodiments, the flow directing structure of the transfer tube may include a cylindrical shape. In such embodiments, the inlet 45 and the outlet 46 may include a circular shape. As stated, the flow sleeve 26 may have a cylindrical shape. The liner 24 may also be cylindrical shape. The liner 24 may be positioned within the flow sleeve 26 such that, cross-sectionally, the components form concentric circles.

The edge of the transfer tube at the outlet 46 may have a surface contour that corresponds to the inner surface contour of the liner 24. In this manner, the outlet 46 may have a desired configuration in relation to the inner surface of the liner 24 at the injection point. In one embodiment, the outlet 46 may include a surface contour that corresponds to the contour of the inner wall surface of the liner 24 such that the outlet 46 resides approximately flush in relation to the inner wall surface of the liner 24. In the case where the liner 24 is cylindrical in shape, the outlet 46 would have a slightly rounded profile that matches the rounded contour of the inner surface of the liner 24. In another embodiment, the corresponding surface contour of the outlet 46 may allow the edge of the outlet 46 to reside in a uniformly recessed position in relation to the inner wall surface of the liner 24. This may allow be a margin by which the outlet 46 may shift during operation (for example, because of mechanical loads or thermal expansion) and still not protrude into the flow of working fluid through the liner 24. It will be appreciate that if the outlet 46 protrudes into the flow of working fluid, aerodynamic losses might be incurred.

Figure 8:
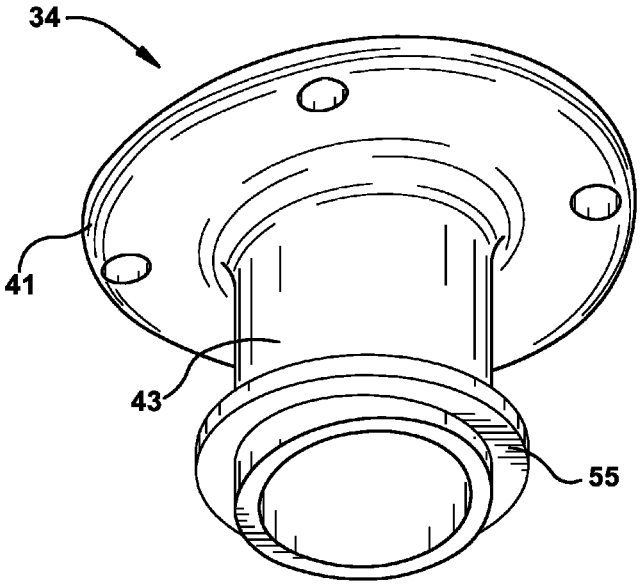
FIG. 8 is a perspective view of a transfer tube according to an alternative embodiment of the present invention.
Figure 9:
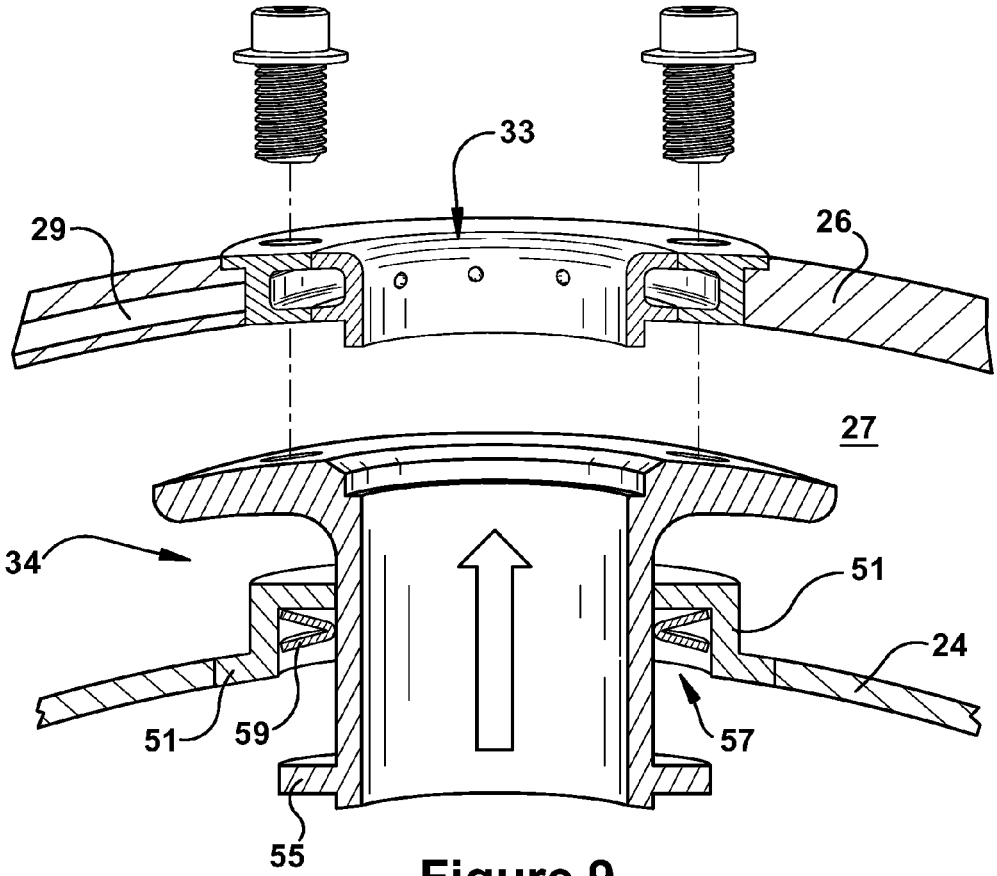
FIG. 9 is a section view of a late lean injector/transfer tube assembly according to an alternative embodiment of the present invention in an unassembled state.
Figure 10:
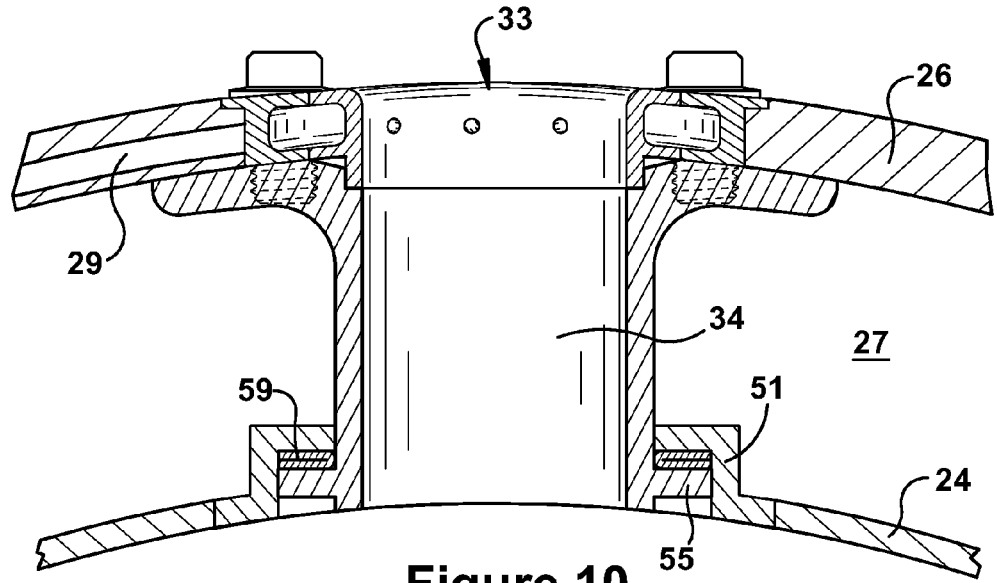
FIG. 10 is a section view of a late lean injector/transfer tube assembly according to an alternative embodiment of the present invention in an assembled state.

As shown in FIGS. 8 through 10, in an alternative embodiment, the transfer tube may include a stop near the outlet 46. The stop may be used to interact with the boss 51 so that the liner 24/flow sleeve 26 assembly is supported in a more fixed position. It will be appreciated that this may allow the configuration of the flow annulus to be more uniform. In addition, as discussed below, the stop and the boss 51 may be configured such that a damping mechanism is positioned between them. This type of configuration may allow beneficial damping to the liner 24/flow sleeve 26 assembly, as well as to the components of the late lean injector 32, which may extend part life and improve performance.

Accordingly, in the embodiments shown in FIGS. 8 through 10, a boss 51 may be rigidly secured to the liner 24. The boss 51 may be configured to define a hollow passageway through the liner 24. The transfer tube may be slideably engaged within the boss 51. A stop may be formed on the transfer tube. A spring 59 or other damping mechanism may be positioned between the boss 51 and the stop.

The stop may be positioned at a predetermined location toward the end of the transfer tube. In general, the stop may be defined as rigid section of enlargement on the transfer tube. This section of enlargement may be configured such that it is larger than the hollow passageway defined through the boss 51. The section of enlargement may be configured to contact, via the damping mechanism positioned therebetween, the boss 51 such that further withdrawal of the transfer tube from the liner 24 is arrested. In some embodiments, the spring 59 may not be included. It will be appreciated that the predetermined location of the stop on the transfer tube may include one that positions the outlet 46 of the transfer tube at the desirable injection point once the section of enlargement contacts, via the damping mechanism positioned therebetween, the boss 51. In addition, the predetermined location of the stop on the transfer tube may include one that suitably positions the first end of the transfer tube in relation to the late lean nozzle 33 once the section of enlargement contacts, via the damping mechanism positioned therebetween, the boss 51.

As described, the late lean nozzle 33 and the transfer tube may include an attachment mechanism between them that is configured such that, upon engaging, the transfer tube is drawn toward the late lean nozzle 33. It will be appreciated that this type of attachment mechanism may be used to draw the stop against the spring 59 and, then, the spring 59 against the boss 51. In this manner, the spring 59 may be compressed upon engaging that attachment mechanism between the transfer tube and the late lean nozzle 33. The spring 59 then may be compressed a desired amount such that appropriate amount of dynamic damping is provided during usage. In certain embodiments, the stop and the boss 51 each include a contact surface that corresponds to a contact surface on the other. When the transfer tube is drawn toward the late lean nozzle 33, the spring 59 may be compressed between the contact surface of the stop and the contact surface of the boss 51.

In certain embodiments, the damping mechanism includes a spring 59. In other embodiments, the damping mechanism may include a curved washer or an O-ring having desirable elastic properties.

In certain embodiments, the boss 51 includes a recessed compression seat 57, as shown in FIGS. 9 and 10. The recessed compression seat 57 may be recessed a distance that corresponds to the radial height of the stop. In some embodiments, the recessed compression seat 57 may be recessed a distance that corresponds to the radial height of the stop and the radial height of the transfer tube extending beyond the stops. In this manner, the recessed compression seat 57 may allow the outlet 46 of the transfer tube to reside in a preferable position relative to the inner surface of the liner 24. The preferable position, in some embodiments, may have the outlet 46 flush with the inner surface of the liner 24. In other embodiments, the preferable position may have the outlet 46 in a slightly recessed position relative to the inner surface of the liner 24.

The present invention may include a novel method of manufacturing or assembling a late lean injection system 28. More specifically, given the components and system configuration described herein, the present invention includes methods by which a liner 24/flow sleeve 26 assembly may be efficiently assembled and, as a unit, installed within a combustor. It will be appreciated that the methods described herein may be used on newly manufactured combustors, as well as provided an efficient method by which existing or used combustors are retrofitted with a late lean injection system 28.

In general, methods according to the present invention include orienting the liner 24 in an upright, unassembled position, and fully inserting transfer tubes in pre-formed holes through the liner 24. The holes may include already installed bosses 51. As stated, the transfer tubes may be configured to slidably engage the bosses 51. Separately, the flow sleeve 26 may be prepared by drilling the fuel passageway 29 and embedding the late lean nozzles 33 at predetermined locations within the flow sleeve 26. The liner 24/flow tube assembly then may be positioned within the flow sleeve 26/fuel passageway 29/late lean nozzle 33 assembly, and oriented such that the transfer tubes aligned with the late lean nozzles 33. The transfer tubes then may be slid outward so that a connecting mechanism may be engage that secures the transfer tubes to the late lean nozzle 33. The foregoing components may be assembled together as a sub-unit and then installed within the combustor during assembly of the combustor, attaching on one end of the sub-assembly to the CDC and on the downstream end, to the transition piece 25. The head end 22 then may be assembled onto the flow sleeve flange 31 and inserts into the forward end of the liner 24. It should be noted the assembly locates each component relative to each other axially through the fuel nozzles. In other words, the axial position of the liner 24 is retained in the combustor via the late lean injector 32*s*. The radial position of the aft end of the liner 24 is also supported/fixed via the late lean injector 32*s* (which is unique to the present invention, since traditionally the liner 24 is held axially by lugs and stops on the forward end).

More specifically, the present invention includes a method of manufacture for a late lean injection system 28 in a combustor of a combustion turbine engine. The combustor may include a liner 24/flow sleeve 26 assembly that includes a liner 24, which defines a primary combustion chamber downstream of a primary fuel nozzle, and a flow sleeve 26, which surrounds the liner 24 forming a flow annulus therebetween. The method may include the following steps: a) identifying a desired position within the liner 24/flow sleeve 26 assembly for a late lean injector 32 that includes a late lean nozzle 33 and a transfer tube; b) corresponding to the desired position for the late lean injector 32, identifying an injection point on the liner 24 and a late lean nozzle 33 position on the flow sleeve 26; c) positioning the liner 24 and the flow sleeve 26 in an unassembled position; d) while the liner 24 and the flow sleeve 26 are in the unassembled position, forming a hole through the liner 24 at the injection point and slideably engaging the transfer tube within the hole; e) installing the late lean nozzle 33 in the flow sleeve 26 at the late lean nozzle 33 position; f) positioning the liner 24 and flow sleeve 26 in an assembled position; and g) connecting the transfer tube to the late lean nozzle 33. As before, the hole through the liner 24 may include a boss 51 that is assembled therein.

This method may include the repeating of certain of the steps a) through g) so that at least three late lean injector 32*s* are installed within the liner 24/flow sleeve 26 assembly. More specifically, in certain embodiments, the aforementioned steps may be modified to allow for the installation of multiple late lean injector 32*s*. In this case, the method may include the steps of: a) identifying desired positions within the liner 24/flow sleeve 26 assembly for at least three late lean injector 32*s*, wherein each of the late lean injector 32*s* may include the late lean nozzle 33 and the transfer tube; b) corresponding to the desired locations for the late lean injector 32*s*, identifying the injection points on the liner 24 and the late lean nozzle 33 positions on the flow sleeve 26 for each of the late lean injector 32*s*; c) positioning the liner 24 and the flow sleeve 26 in the unassembled position; d) while the liner 24 and the flow sleeve 26 are in the unassembled position, forming holes through the liner 24 at the injection points and slideably engaging each of the transfer tubes within one of the holes; e) installing the late lean nozzles 33 in the flow sleeve 26 at the late lean nozzle 33 positions; f) positioning the liner 24 and flow sleeve 26 in the assembled position; and g) includes connecting the transfer tubes to the corresponding late lean nozzles 33.

It will be appreciated that the step of identifying desired positions for the at least three late lean injector 32*s* may be based upon the late lean injector 32*s* supporting the liner 24 relative to the flow sleeve 26 in a desired position. In certain embodiments, the desired positions for the at least three late lean injector 32*s* may include spaced angular positions about a constant axial position within the liner 24/flow sleeve 26 assembly. As stated, the flow sleeve 26 and the liner 24 each may include a circular cross-sectional shape. In this instance, the desired configuration at which the liner 24 is supported relative to the flow sleeve 26 may include an approximate concentric configuration. The desired configuration at which the liner 24 is supported relative to the flow sleeve 26 may include one in which the distance between the inner radial wall and the outer radial wall of the flow annulus conform to predetermined dimensional criteria.

It will be appreciated that the unassembled position may include one in which the liner 24 is outside of the flow sleeve 26. In this state, it will be appreciated that access to each of these components is convenient. The assembled position may include one in which the liner 24 is inside of the flow sleeve 26 and positioned similar to how the liner 24 will be once the liner 24/flow sleeve 26 assembly is fully assembled. The assembled position may further be described as one in which the liner 24 is inside of the flow sleeve 26 and positioned such that each of the transfer tubes aligns with a corresponding late lean nozzle 33.

The method may include the step of forming the fuel passageway 29 through flow sleeve 26. In certain embodiments, this may include a drilling process.

The method may include sliding the transfer tube into a first position before the liner 24 and the flow sleeve 26 are positioned in the assembled position. The first position may include one in which a significant portion of the transfer tube juts from an inner surface of the liner 24. The first position may allow the clearance necessary for the liner 24 to be positioned within the flow sleeve 26. The transfer tube then may be slid into a second position once the liner 24 is positioned within the flow sleeve 26. The second position may include one in which a significant portion of the transfer tube juts from an outer surface of the liner 24. The second position also may allow the transfer tube to engage the late lean nozzle 33.

In some embodiments, the method may include welding the boss 51 to the liner 24, welding the late lean nozzle 33 to the flow sleeve 26; and connecting the fuel passageway 29 to the late lean nozzle 33. In addition, once the line/flow sleeve 26 assembly is assembled as a unit, the method may include installing that unit within the combustor. It will be appreciated that the installation of the liner 24/flow sleeve 26 assembly may include rigidly attaching an aft end of the liner 24 to the transition piece and rigidly attaching a forward end of the liner 24 to a primary fuel nozzle assembly.

In addition, the method may further include the step of pressure testing the late lean injection system 28 before installing the liner 24/flow sleeve 26 assembly in the combustor, and/or inspecting the late lean injection system 28 before installing the liner 24/flow sleeve 26 assembly in the combustor. In this manner, the liner 24/flow sleeve 26 assembly with the late lean injection system 28 may be conveniently tested and adjusted as necessary. It will be appreciated that these final steps would be much more difficult if the unit were not able to be preassembled outside of the combustor. The pressure testing may include: pressure testing the connection between the transfer tube and the late lean nozzle 33 for leaks; and pressure testing the connection between the fuel passageway 29 and the late lean nozzle 33.

In embodiments in which a stop 55 is included, the step of slideably engaging the transfer tube 34 within the boss 51 may include sliding the transfer tube 34 into the boss 51 from a position outside of the liner 24. The transfer tube 34 may be slid through the boss 51 until the flange 41 of the transfer tube 55 prevent further insertion, which will result in the other end of the transfer tube 34 projecting from the inner surface of the liner 24 toward the interior there of. The stop 55 then may be rigidly connected to the portion of the transfer tube that now projects into the liner 24. Any type of mechanical attachment mechanism or weld may be used for this. The boss 51 may be positioned at a predetermined location. As previously described, the stop 55 may be configured to arrest withdrawal of the transfer tube 34 from the outer surface of the liner 24 once it projects from the exterior surface a desired length. The desired length that the transfer tube 34 projects from the exterior surface of the liner 24 may coincide with a desired spatial relation between the liner 24 and the flow sleeve 26 in the liner 24/flow sleeve 26 assembly.

Figure 11:
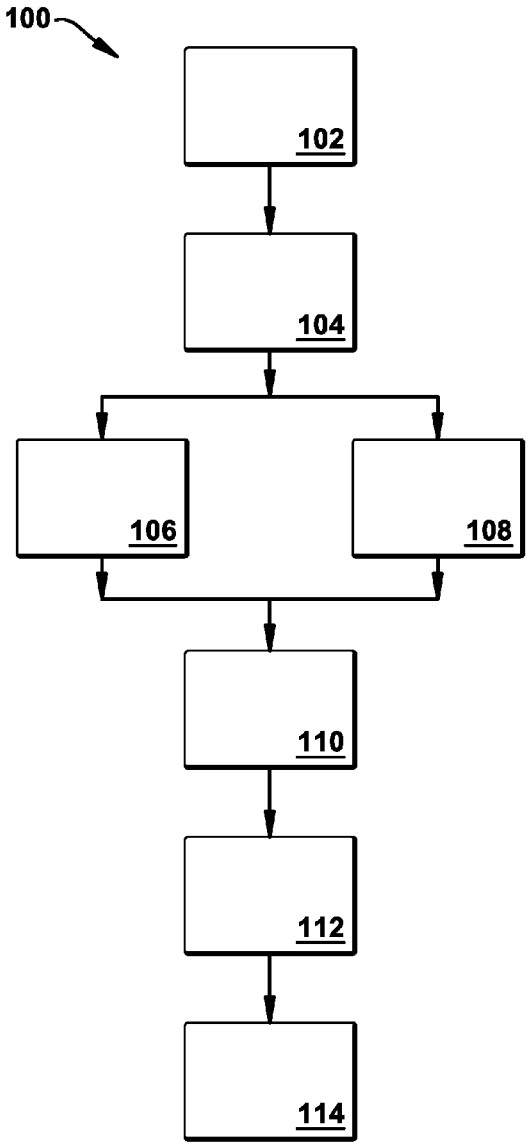
FIG. 11 is a flow diagram according to an exemplary embodiment of the present invention.

Referring now to FIG. 11, a flow diagram is provided that includes a preferred embodiment encompassing a number of the steps described above. It will be appreciated that any of the components and/or steps described above may be accommodated within this exemplary framework.

At an initial step 102, a desired position within the liner 24/flow sleeve 26 assembly for one or more late lean injector 32*s* may be determined. At a step 104, corresponding to the desired position for the late lean injector 32*s*, injection points on the liner 24 and late lean nozzle 33 positions on the flow sleeve 26 may be determined.

At this point, the method may include steps that may be performed separately and concurrently, and with the liner 24 and flow sleeve 26 occupying, in relation to each other, unassembled positions. Accordingly, at a step 106, the liner 24, occupying an unassembled position, may be prepared separately for assembly with the flow sleeve 26 at a late time. Step 106 may include those steps described above relating to slidably engaging the transfer tubes through bosses 51 positioned at predetermined injection points. The transfer tubes may be fully inserted into the bosses 51 so that clearance to position the liner 24 in the flow sleeve 26 is available once that step is performed.

Meanwhile, at a step 108, the flow sleeve 26, occupying an unassembled position, may be prepared separately for assembly with the liner 24 at a late time. Step 108 may include those steps described above relating to assembling the flow sleeve 26, fuel passageway 29, late lean nozzle 33 assembly.

At a step 110, the liner 24 and flow sleeve 26 may be brought together in an assembled position. At a step 112, the transfer tubes may be connected to their corresponding late lean nozzles 33. Finally, at a step 114, pressure testing and inspection of the unit may be performed, and installation within the combustor completed. Further steps (not shown) may include one in which the assembled liner 24/flow sleeve 26 is integrated into a new combustor unit within a factory setting. In other embodiments, the assembled liner 24/flow sleeve 26 may be shipped as a complete or assembled unit and installed as an upgrade in existing combustors that are already being operated in the field (i.e., used combustors).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A transfer tube for use in a late lean injection system of a combustor of a combustion turbine engine, wherein the combustor includes an inner radial wall, which defines a primary combustion chamber downstream of a primary fuel nozzle, and an outer radial wall, which surrounds the inner radial wall forming a flow annulus therebetween, the outer radial wall including a late lean nozzle, the transfer tube comprising:

flow directing structure that defines a fluid passageway; wherein:

at a first end, the flow directing structure includes an inlet rigidly connected to the late lean nozzle;

at a second end, the flow directing structure includes an outlet; and the flow directing structure comprises a configuration such that the fluid passageway spans the flow annulus and positions the outlet at a desirable injection point in the inner radial wall;

the desirable injection point comprises a position along an inner wall surface of the inner radial wall, and the flow directing structure comprises a tube having a predetermined length, the predetermined length corresponding with the distance between the late lean nozzle and the desirable injection point;

at the second end, the transfer tube comprises a configuration that slidably and snuggly engages a boss installed through the inner radial wall, the boss defining a hollow passageway through the inner radial wall;

further comprising a stop positioned at a predetermined location toward the second end of the transfer tube;

wherein the stop comprises a rigid section of enlargement that is larger than the hollow passageway defined by the boss, the section of enlargement being configured to arrest further withdrawal of the transfer tube from the inner radial wall once the section of enlargement contacts the boss.

2. The transfer tube according to claim 1, wherein the inner radial wall comprises a liner and the outer radial wall comprises a flow sleeve.

3. The transfer tube according to claim 1, wherein the inner radial wall comprises a transition piece and the outer radial wall comprises an impingement sleeve.

4. The transfer tube according to claim 2, wherein the flow directing structure is configured to fluidly connect the inlet and the outlet and, in operation, separate a first fluid flowing through the flow directing structure from a second fluid flowing through the flow annulus.

5. The transfer tube according to claim 4, wherein the flow directing structure comprises a flange that surrounds the inlet.

6. The transfer tube according to claim 5, wherein the flange includes a plurality of threaded openings configured to engage bolts that originate from the late lean nozzle, each of the threaded openings being configured such that engagement of the bolts draw the flange toward the late lean nozzle.

7. The transfer tube according to claim 6, wherein the flange includes a compression seat against which a corresponding surface of the late lean nozzle may be drawn when the bolts are fully engaged.

8. The transfer tube according to claim 6, wherein the flow directing structure comprises a narrowing ledge just inside of the inlet; and wherein the narrowing ledge is configured to provide a compression seat against which an edge of a projecting ring formed on the late lean nozzle may be drawn when the bolts are fully engaged.

9. The transfer tube according to claim 6, wherein an inner surface of the flow sleeve comprises an outer radial boundary of the flow annulus, and wherein the inner surface of the flow sleeve comprises a surface contour;

wherein an outer face of the flange comprises a surface contour; and wherein the surface contour of the outer face of the flange is configured to correspond to the surface contour of the inner surface of the flow sleeve.

10. The transfer tube according to claim 9, wherein the surface contour of the outer flange is configured such that, when the engagement of the bolts draws the flange against the flow sleeve, substantially all of the outer face of the flange is drawn tightly against the inner surface of the flow sleeve.

11. The transfer tube according to claim 9, wherein the flow directing structure comprises a cylindrical tube;

wherein the inlet and the outlet comprise a circular shape; and wherein the flow sleeve and the liner each comprises a circular cross-sectional shape.

12. The transfer tube according to claim 11, wherein an edge of the transfer tube at the outlet comprises a surface contour that corresponds to the contour of the inner wall surface of the liner such that the outlet resides approximately flush in relation to the inner wall surface of the liner.

13. The transfer tube according to claim 11, wherein an edge of the transfer tube at the outlet comprises a surface contour that corresponds to the contour of the inner wall surface of the liner such that the outlet resides uniformly recessed in relation to the inner wall surface of the liner.

14. The transfer tube according to claim 2, wherein the flow sleeve includes a longitudinally extending fuel passage formed therein that supplies fuel to the late lean nozzle embedded within the flow sleeve.

15. The transfer tube according to claim 2, further comprising a stop positioned at a predetermined location toward the second end of the transfer tube;

wherein the stop comprises a rigid section of enlargement that is larger than the hollow passageway defined by the boss, the section of enlargement being configured to arrest further withdrawal of the transfer tube from the liner once the section of enlargement contacts the boss.

16. The transfer tube according to claim 15, wherein the predetermined location of the stop comprises one at which, when the section of the enlargement contacts the boss: i) the outlet of the transfer tube comprises the desirable injection point, and ii) the first end of the transfer tube protrudes from the liner a predetermined distance.

17. The transfer tube according to claim 16, wherein the predetermined distance that the first end of the transfer tube protrudes from the liner comprises a distance that results in the first end of the transfer tube engaging the late lean nozzle in a desired manner.

18. The transfer tube according to claim 6, wherein the late lean nozzle comprises a cylindrical configuration that defines a hollow passageway through the flow sleeve; wherein a plurality of fuel outlets are formed on an inner surface of the cylindrical configuration.

19. The transfer tube according to claim 2, wherein the late lean injection system comprises a system for injecting a mixture of fuel and air within the aft end of the primary combustion chamber defined by the liner; and wherein the flow annulus is configured to carry a supply of compressed air toward a forward end of the combustor.

20. A transfer tube for use in a late lean injection system of a combustor of a combustion turbine engine, wherein the combustor includes an inner radial wall, which defines a primary combustion chamber downstream of a primary fuel nozzle, and an outer radial wall, which surrounds the inner radial wall forming a flow annulus therebetween, the outer radial wall including a late lean nozzle, the transfer tube comprising flow directing structure that defines a fluid passageway;

wherein:

at a first end, the flow directing structure includes an inlet rigidly connected to the late lean nozzle;

at a second end, the flow directing structure includes an outlet;

the flow directing structure comprises a configuration such that the fluid passageway spans the flow annulus and positions the outlet at a desirable injection point in the inner radial wall that comprises a position along an inner wall surface of the liner;

the flow directing structure comprises a tube having a predetermined length, the predetermined length corresponding with the distance between the late lean nozzle and the desirable injection point;

at the second end, the transfer tube comprises a configuration that slidably and snugly engages a boss installed through the liner, the boss defining a hollow passageway through the liner;

the flow directing structure is configured to fluidly connect the inlet and the outlet and, in operation, separate a first fluid flowing through the flow directing structure from a second fluid flowing through the flow annulus;

the flow directing structure comprises a flange that surrounds the inlet, the flange includes a plurality of threaded openings configured to engage bolts that originate from the late lean nozzle, each of the threaded openings being configured such that engagement of the bolts draw the flange toward the late lean nozzle; and the flow directing structure comprises a narrowing ledge just inside of the inlet, the narrowing ledge being configured to provide a compression seat against which an edge of a projecting ring formed on the late lean nozzle may be drawn when the bolts are engaged.

* * * * *